US010446901B1

(12) United States Patent
Scanlan et al.

(10) Patent No.: US 10,446,901 B1
(45) Date of Patent: Oct. 15, 2019

(54) SYSTEM AND METHOD FOR GUARDING AN ANTENNA FROM INTERFERING PHYSICAL OBJECTS

(71) Applicant: Science Applications International Corporation, Reston, VA (US)

(72) Inventors: Martin Scanlan, Andover, MN (US); Dale Hollenbaugh, Clyde, MI (US)

(73) Assignee: Science Applications International Corporation, Reston, VA (US)

( * ) Notice: Subject to any disclaimer, the term of this patent is extended or adjusted under 35 U.S.C. 154(b) by 0 days.

(21) Appl. No.: 16/161,505

(22) Filed: Oct. 16, 2018

(51) Int. Cl.

| | |
|---|---|
| ***H01Q 1/32*** | (2006.01) |
| ***H01Q 1/00*** | (2006.01) |
| ***H01Q 1/52*** | (2006.01) |
| ***H01Q 19/26*** | (2006.01) |
| ***H01Q 1/42*** | (2006.01) |

(52) U.S. Cl.
CPC ..... *H01Q 1/002* (2013.01); *H01Q 1/32* (2013.01); *H01Q 1/428* (2013.01); *H01Q 1/521* (2013.01); *H01Q 19/26* (2013.01)

(58) Field of Classification Search
CPC ..... H01Q 1/002; H01Q 1/32; H01Q 1/428; H01Q 1/521
See application file for complete search history.

(56) References Cited

U.S. PATENT DOCUMENTS

| | | | | |
|---|---|---|---|---|
| 3,383,694 | A | 5/1968 | Strohmeyer, Jr. | 343/833 |
| 3,442,476 | A | 5/1969 | Trimble | 248/43 |
| 3,602,088 | A | 8/1971 | Spring | 89/36 K |
| 3,789,414 | A | 1/1974 | Bauer et al. | 343/761 |
| 4,254,419 | A | 3/1981 | Noddin | 343/715 |
| 4,377,812 | A | 3/1983 | Göbel et al. | 343/872 |
| 4,625,213 | A | 11/1986 | Hom | 343/715 |
| 4,864,322 | A | 9/1989 | Yamamoto et al. | 343/903 |
| 5,506,593 | A * | 4/1996 | Peng | H01Q 1/084 343/715 |
| 6,331,838 | B1 | 12/2001 | Scott et al. | 343/715 |
| 8,085,207 | B2 | 12/2011 | Miller et al. | 343/711 |
| 9,130,264 | B2 | 9/2015 | Gervais | 343/709 |
| 2003/0112191 | A1 | 6/2003 | Maeda et al. | 343/715 |
| 2013/0300620 | A1 | 11/2013 | Gervais | 343/757 |
| 2017/0299318 | A1 | 10/2017 | Oesmann et al. | F41A 27/02 |

OTHER PUBLICATIONS

First RF Corporation, "FRF-105 Series Data Sheet," Antenna & RF Systems Technology, Copyright 2011-2013, 1 p.
International Search Report and Written Opinion for Application No. PCT/US2018/056060, 9 pp., dated Jan. 8, 2019.

* cited by examiner

*Primary Examiner* — Graham P Smith
(74) *Attorney, Agent, or Firm* — Dawn-Marie Bey; Bey & Cotropia PLLC

(57) ABSTRACT

A passive antenna guard system includes an antenna guard at a location of the antenna and mounted on a common mount therewith which facilitates movement of the antenna from the path of an object responsive to the object contacting the antenna guard. The system may include a balance system which allows the antenna and antenna guard to spring back into place after the object clears the antenna guard.

21 Claims, 17 Drawing Sheets

Top View

Top View

SYSTEM AND METHOD FOR GUARDING AN ANTENNA FROM INTERFERING PHYSICAL OBJECTS

BACKGROUND

Field of the Embodiments

The embodiments are generally directed to systems and methods for protecting antennas from physical interference and damage. More specifically, the embodiments are directed to systems and methods for physically moving directional antennas out of the way of potentially damaging physical interferents.

Description of the Related Art

It is generally known in the antenna art that antenna placement and directionality are important features for optimization of transmission and/or reception of signals. Ideally, antennas would be placed such that there is a clear line of sight to the emitter of signals received at the antenna and to the intended recipient of signals transmitted by the antenna. To this end, antennas are often placed in physically vulnerable positions where they are susceptible to both electromagnetic and physical interferents. Various prior art references describe systems and methods for protecting antennas from physical damage. U.S. Pat. No. 4,377,812 describes a protection shell for encasing an antenna tower therein. Similarly, U.S. Pat. No. 3,442,476 describes an Antenna Guard which may be telescopically raised and lowered over an antenna. U.S. Pat. No. 4,625,213 for an Antenna Mount and U.S. Pat. No. 6,331,838 for a Flexible Vehicle Antenna, describe antennas for use on a motor vehicle that are flexibly attached to the vehicle using a coil spring in the mount, which allows the antenna to deflect in the event it is impacted by a foreign object and/or wind. And various other references include descriptions of systems for raising and lowering antennas in accordance with their use. Examples of such teachings are found in U.S. Pat. No. 4,254,419, which is directed to Mobile Antenna Raising and Lowering Device and includes a motorized system for raising and lowering an antenna, and in U.S. Pat. No. 9,130,264, which is directed to Apparatus for Raising and Lowering Antennae using an actuator system.

But there remains an unmet need in the antenna art for a system and method which provides antenna protection under more particular circumstances wherein, for example, a directional antenna encounters a substantial physical blow or object and must be capable of not only surviving the impact, but also must be able to resume directional reception immediately thereafter. Directional antennas radiate or receive greater power in specific directions, thus facilitating better performance by reducing interference from non-specific directions. By way of a specific example, directional antennas for disrupting IEDs may be positioned on the front of a tank and in the direct path of the tank gun barrel. The prior art teachings are not rugged or responsive enough to adequately protect the directional antenna from physical and operational damage.

SUMMARY OF THE EMBODIMENTS

In a first exemplary embodiment, an antenna guard system includes: an antenna mounted on a first sub-mount component; an antenna guard mounted on the first sub-mount component adjacent to the antenna, wherein the antenna guard is wider and higher than the antenna; a second sub-mount component including a rotatable shaft therethrough, the rotatable shaft connecting the first sub-mount to the second sub-mount for rotating the first sub-mount including the antenna and antenna guard away from an operational position and out of a path of a passing object when the antenna guard is contacted by the passing object; and further wherein a balance is movably attached to the rotatable shaft for repositioning the first sub-mount in the approximately vertical position once the passing object is no longer contacting the antenna guard.

In a second exemplary embodiment, an antenna guard system includes: an antenna mounted on a rotatable mount; and an antenna guard mounted on the rotatable mount component adjacent to the antenna, wherein the antenna guard is wider and higher than the antenna; wherein the antenna guard of the antenna guard system is located in a path of one or more passing objects and further wherein when the antenna guard is contacted by the one or more passing objects, the rotatable mount rotates to move the antenna guard and the antenna out of the path thereof.

In a third exemplary embodiment, a tank includes: a movable turret including a gun barrel; and a directional antenna system located in a path of the gun barrel, the directional antenna system including a rotatable mount having thereon an antenna and an antenna guard, wherein when the gun barrel contacts the antenna guard, the rotatable mount rotates to move the antenna and the antenna guard out of the path of the gun barrel.

In a fourth exemplary embodiment, an antenna guard system includes: an antenna mounted on a spring mount; and an antenna guard mounted on the spring mount component adjacent to the antenna, wherein the antenna guard is wider and higher than the antenna; wherein the antenna guard of the antenna guard system is located in a path of one or more passing objects and further wherein when the antenna guard is contacted by the one or more passing objects, the spring mount causes the antenna guard and the antenna to move out of the path thereof.

BRIEF DESCRIPTION OF THE FIGURES

The following figures are intended to represent exemplary embodiments and should be considered in combination with the detailed description below.

DETAILED DESCRIPTION

Figure 1C:
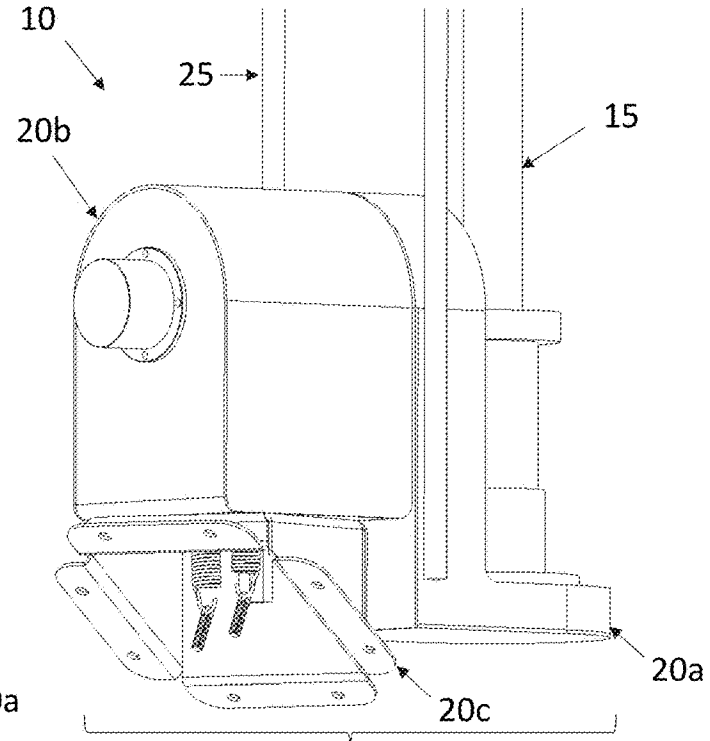
FIGS. 1*a*, 1*b*, and 1*c* are multiple views of an antenna guard system in accordance with at least one embodiment described herein.
Figure 1B:
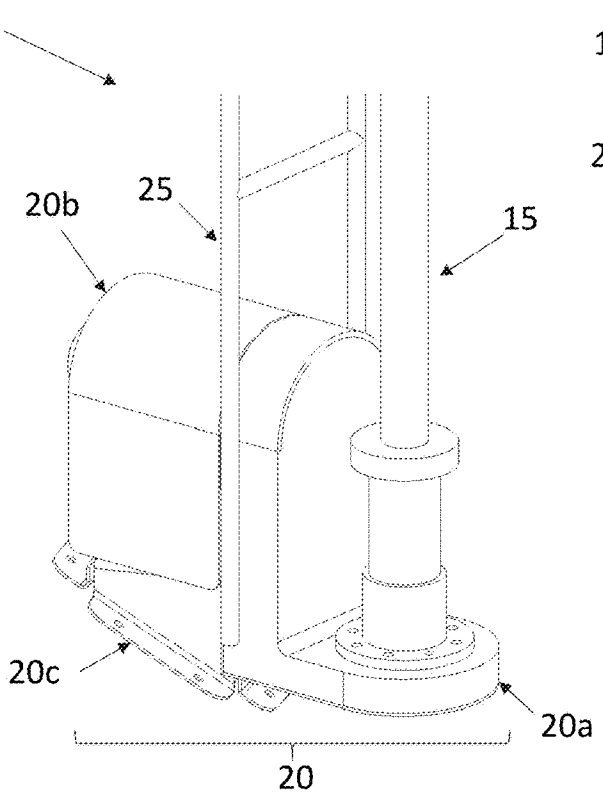
Figure 1A:
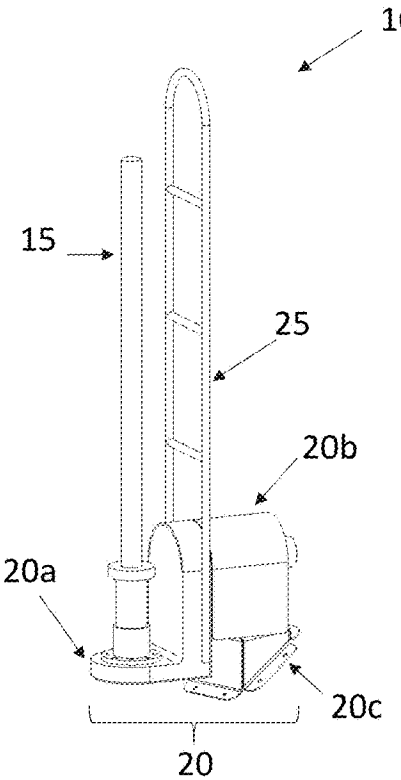

In a first antenna guard system, a passive system uses the gun barrel of a turret mounted gun to push the antenna over upon contact as the gun barrel passes through a location of the antenna and then allows the antenna to spring back into place after the gun barrel clears an antenna guard. More specifically, referring to FIGS. 1*a*, 1*b*, and 1*c*, various external views of an exemplary passive antenna guard system 10 illustrate an antenna 15, antenna mount 20 and antenna guard or halo 25, which is also mounted to the antenna mount 20. More particularly, FIGS. 1*a*, 1*b*, and 1*c* provide various external views of the antenna mount 20 which includes separate sub-mount components 20*a*, 20*b* and 20*c*. As shown, antenna 15 and halo 25 are mounted to sub-mount component 20*a* at different points thereof.

Figure 2A:
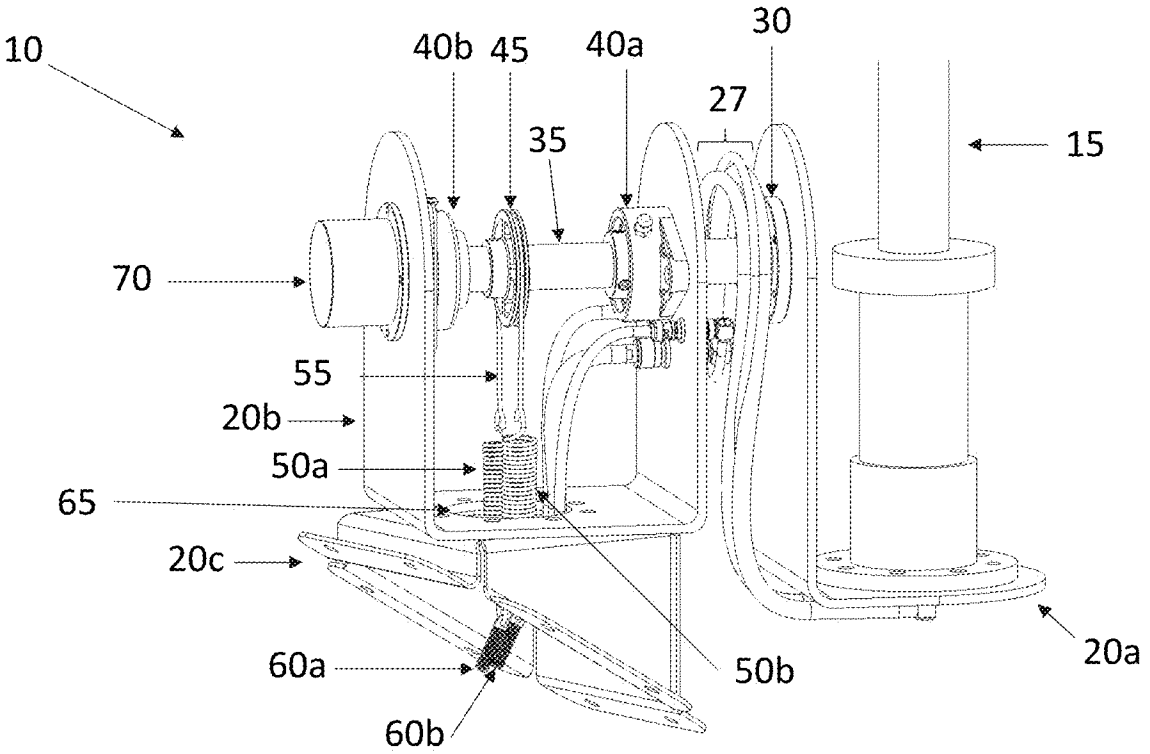
FIGS. 2*a*, 2*b*, and 2*c* are multiple internal views of an antenna guard system in accordance with at least one embodiment described herein.
Figure 2B:
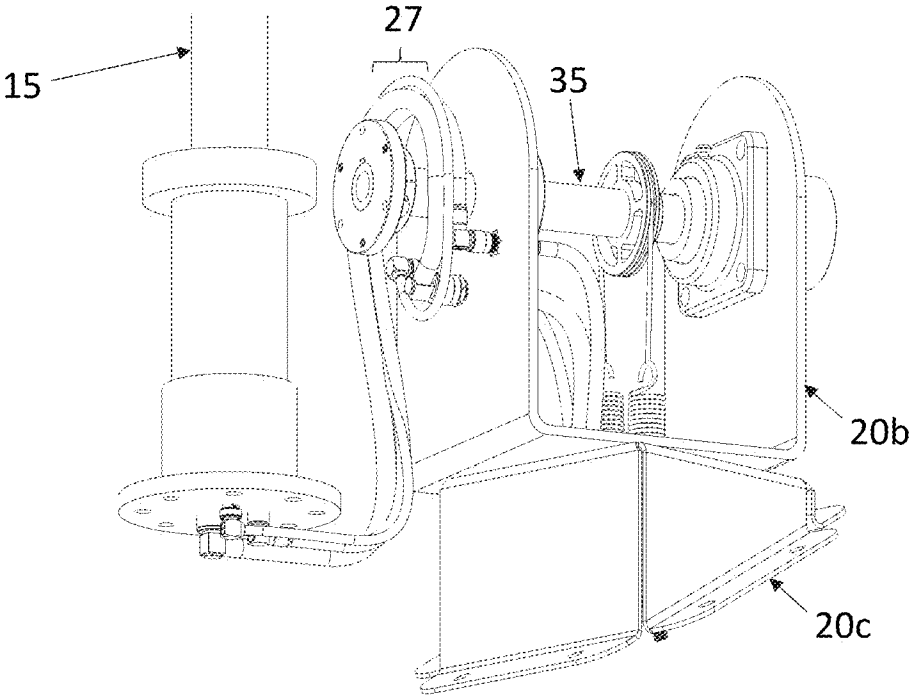
Figure 2C:
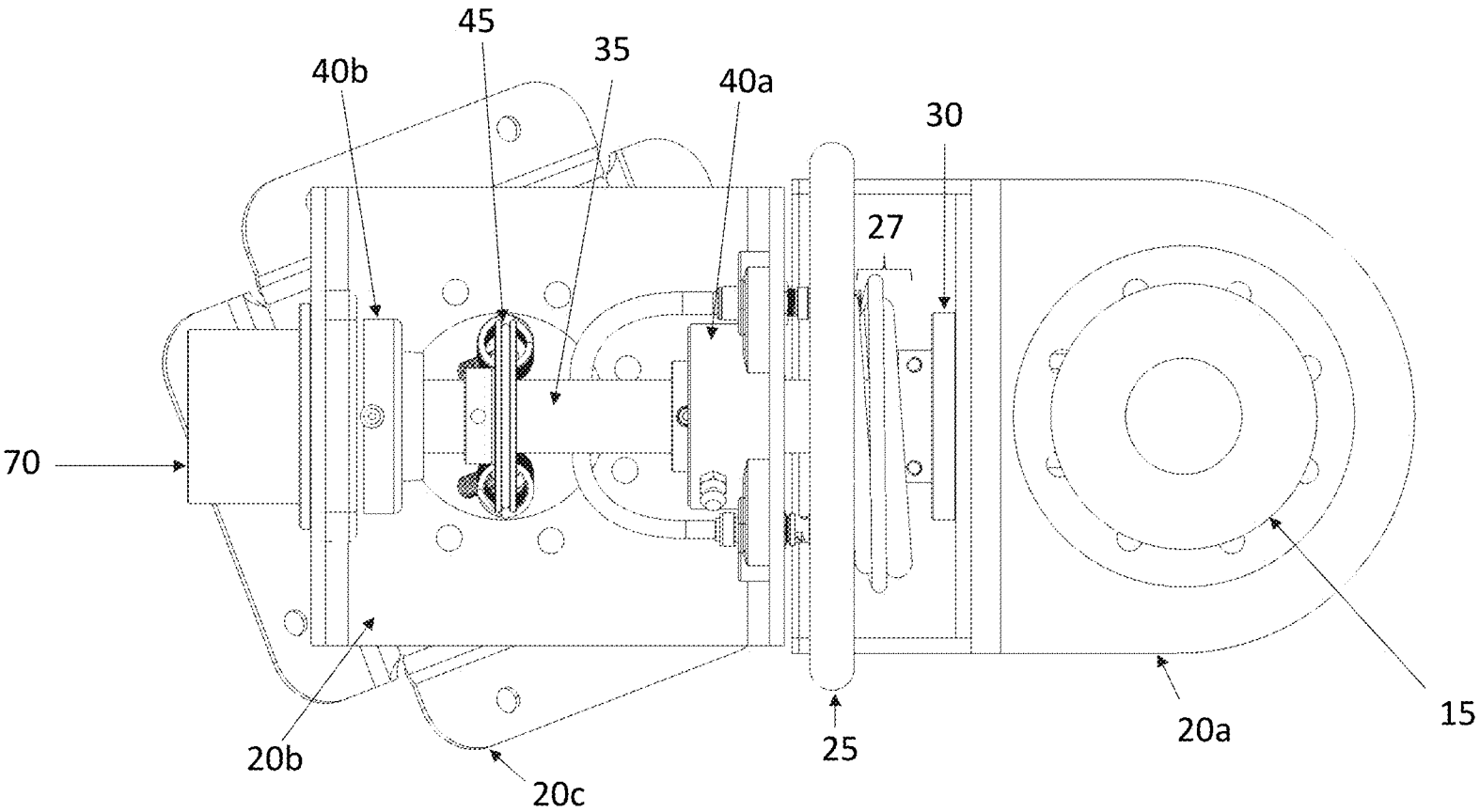
Figure 3B:
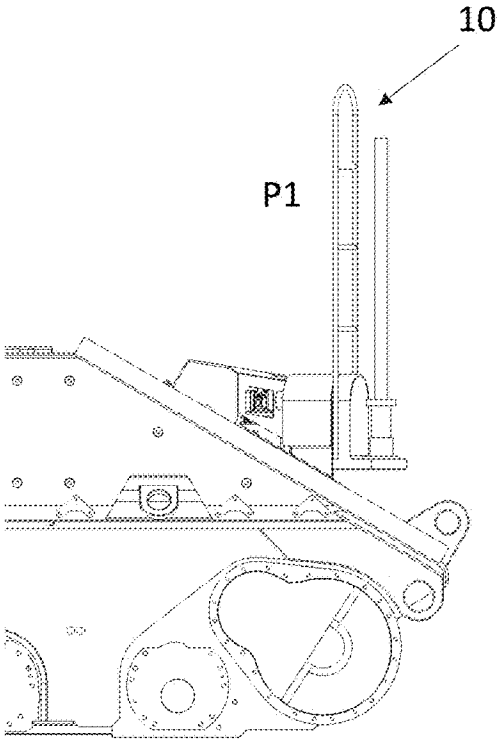
FIGS. 3*a*, 3*b*, 3*c*, and 3*d* are multiple views of an antenna guard system positioned on a tank in accordance with at least one embodiment described herein.
Figure 3A:
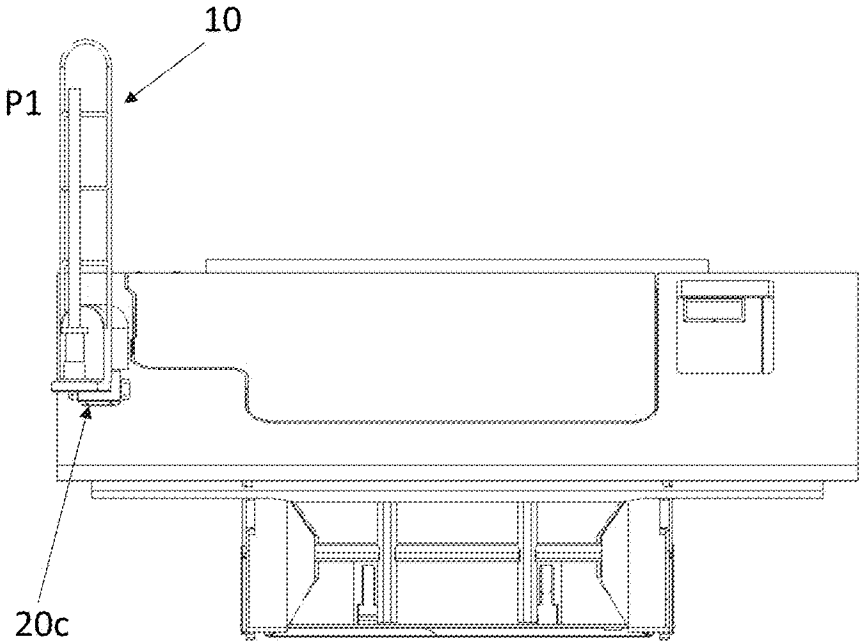
Figure 3D:
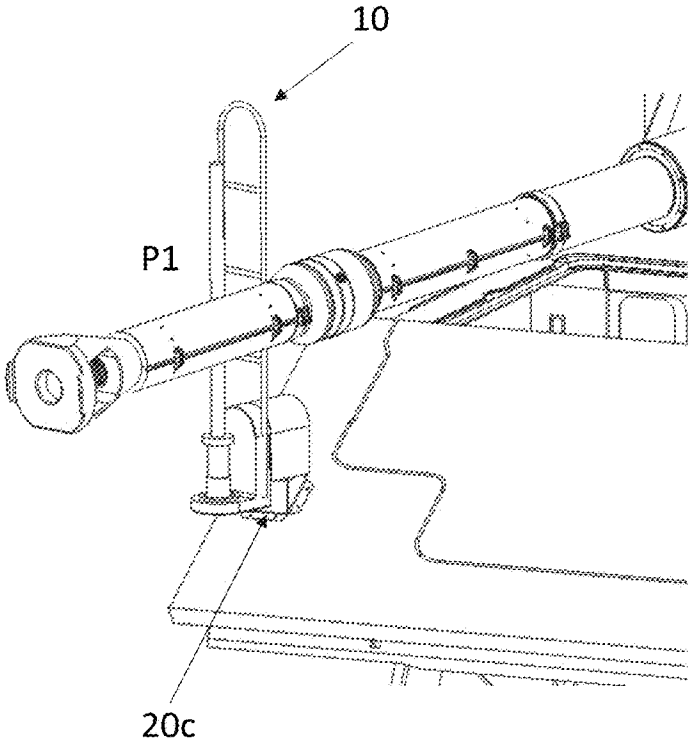
Figure 3C:
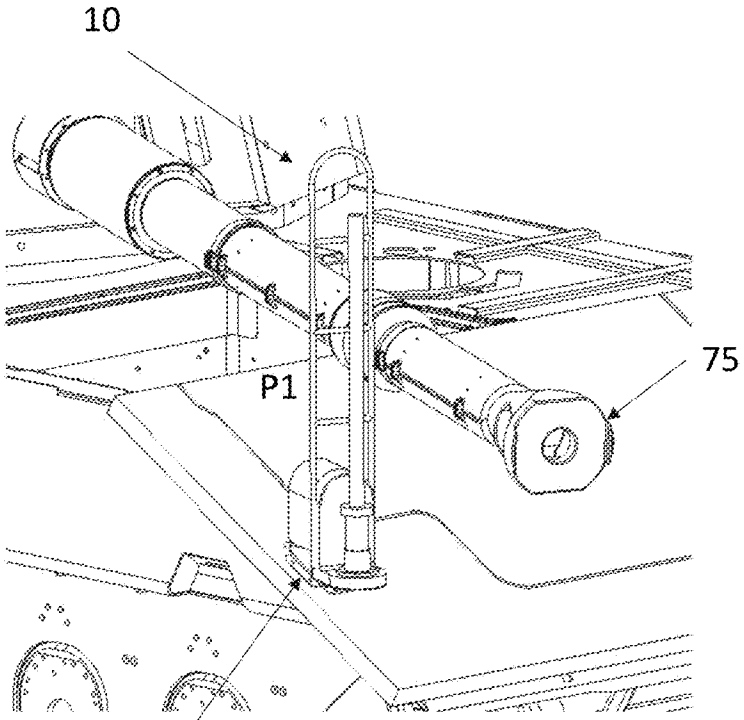

FIGS. 2*a*, 2*b* and 2*c* illustrate various internal views of an exemplary passive antenna guard system 10 in accordance with one embodiment, including various internal components. As shown, antenna mount 20 may include separate sub-mount components 20*a*, 20*b* and 20*c* (shown with outside covers shown in FIGS. 1*a*, 1*b*, and 1*c* removed). Not all embodiments require multiple sub-mounts (see, for example, the embodiments of FIGS. 7*a*, 7*b*, and 7*c*). In the particular implementation illustrated in FIGS. 2*a*, 2*b* and 2*c*, RF signals received by antenna 15 are communicated to a backend receiver (not shown) via one or more RF cables, collectively labelled 27. The number and type of RF cables may vary in accordance with antenna type, intended use and antenna manufacturer specifications. By way of example only, the antenna 15 of the exemplary embodiment shown in FIGS. 2*a* and 2*b* may include three RF cables 27. Such an antenna may be of the type provided by First RF Corporation as part of the FRF-105 series, and described in the specification sheet therefore entitled FRF-105 Series Data Sheet last revised Apr. 26, 2013 (hereafter "First RF Data Sheet"). As shown in FIGS. 2*a* and 2*b* the cables 27 extend from the bottom of sub-mount 20*a* and the antenna 15 and pass through sub-mount components 20*b* and 20*c* to a receiver (not shown).

On skilled in the art will appreciate that depending on the diameter of cables 27 (non-limiting examples include, e.g., 0.25 inches, 0.375 inches and 0.5 inches) they may be difficult to bend. For example, it is known that the minimum repeatable bend radius may be 2.5" for large Type N RF cable. Accordingly, to manipulate and thread the cables 27 through the various sub-mount components 20*b* and 20*c*, it may be necessary to wind the cables 27 around the shaft 35 either partially (as shown) or multiple times to allow for slack when the sub-mount component 20*a* is tilting in accordance with embodiments herein. FIGS. 2*a*, 2*b* and 2*c* show bulkhead and right angle connectors at pass through points for the cables 27, but one skilled in the art recognizes that these connectors may not be necessary so long as the cables 27 are able to accommodate the rotating motion of sub-mount component 20*a* including antenna 15.

As described further herein, sub-mount component 20*a* is rotatably connected to sub-mount component 20*b*. More specifically, a collar 30 connects rotatable shaft 35 from sub-mount component 20*b* to 20*a*. Rotatable shaft 35 may be fixed relative to collar 30 and sub-mount 20*a*. Within sub-mount component 20*b*, rotatable shaft 35 passes through bearings 40*a*, 40*b*, as well as balance 45 which includes springs 50*a*, 50*b* connected to either end of balance cable 55 at first ends thereof and to spring anchors 60*a*, 60*b* at opposite ends thereof. Springs 50*a*, 50*b* and spring anchors 60*a*, 60*b* pass freely through holes (collectively labeled 65) in both sub-mount components 20*b* and 20*c* aligned at an interface therebetween. A damper 70 is located on an outer face of sub-mount component 20*b* and is connected to rotatable shaft 35.

FIGS. 3*a*, 3*b*, 3*c* and 3*d* illustrate various views showing a location of the antenna guard system 10 on a tank (FIGS. 3*a* and 3*b*) and the placement, mounting and relationship thereof to a movable gun barrel 75 attached to the tank. As shown, the sub-mount component 20*c* of the antenna mount 20 is securely bolted to the tank. In one embodiment, antenna 15 may be positioned on the tank at a location where the antenna 15 is in a path of the moveable gun barrel 75. Specifically, antenna 15 may be positioned on a forward facing portion of the tank as part of an electronic jammer system designed to prevent the remote RF-controlled detonation of land mines and IEDs.

Accordingly, during operation, when the gun barrel 75 swings in the direction of the antenna guard system 10, the gun barrel 75 contacts the halo 25 rather than antenna 15. Halo 25 may be fixed relative to sub-mount component 20*a*, which is part of a corresponding tilt mechanism of antenna guard system 10. Specifically, the tilt mechanism comprises various interconnected portions of sub-mount components 20*a* and 20*b*, including but not limited to collar 30, rotatable shaft 35, bearings 40*a*, 40*b* and damper 70, as well as balance 45, which includes springs 50*a*, 50*b*, cable 55 and spring anchors 60*a*, 60*b*. When the gun barrel 75 physically encounters the halo 25, halo 25 rotates around a longitudinal axis defined by rotatable shaft 35. Because halo 25 may be fixed relative to sub-mount component 20*a*, rotatable shaft 35, and antenna 15, these various components also rotate away from the gun barrel 75 and around the axis defined by rotatable shaft 35.

During physical contact between gun barrel 75 and halo 25, the sub-mount component 20*a*, including antenna 15 and halo 25, may move between a start position P1 and an end position P2. The start position P1 may be the position of halo 25 absent contact by a moving object. In one example, start position P1 is an upright position that extends in a direction that is approximately perpendicular to the ground. The range over which halo 25 moves (e.g., the degrees between P1 and P2) during contact by gun barrel 75 depends on the height of gun barrel 75 relative to antenna mount 20. If gun barrel 75 is closer to antenna mount 20 during contact, end position P2 may be an approximately horizontal position such that the difference between P1 and P2 is approximately 90 degrees. However, if gun barrel 75 contacts halo 25 farther away from antenna mount 20, halo 25 may only tilt slightly before gun barrel 75 clears halo 25.

It should be understood that gun barrel 75 can travel in two directions D1 and D2. Accordingly, the rotatable shaft 35 of the antenna guard system 10 may rotate away from the gun barrel 75 and in each direction of travel of the gun barrel 75. As gun barrel 75 moves back and forth, halo 25 may cause the tilt of the sub-mount component 20*a*, antenna 15, and halo 25 to allow the gun barrel 75 to pass thereover without physically contacting antenna 15. In one example, halo 25 has a range of motion of at least 90 degrees in each direction from start position P1.

FIGS. 4*a*, 4*b*, 4*c*, 4*d*, 4*e*, and 4*f* illustrate the relative positions of the gun barrel 75 and the antenna guard system 10, as the gun barrel 75 passes through and over the location of the antenna guard system 10 in a first direction D1.

FIGS. 5*a*, 5*b*, 5*c*, 5*d*, 5*e*, 5*f*, 5*g* and 5*h* illustrate the relative positions of the gun barrel 75 and the antenna guard system 10, as the gun barrel 75 passes through and over the location of the antenna guard system 10 in a second direction D2.

Figure 4B:
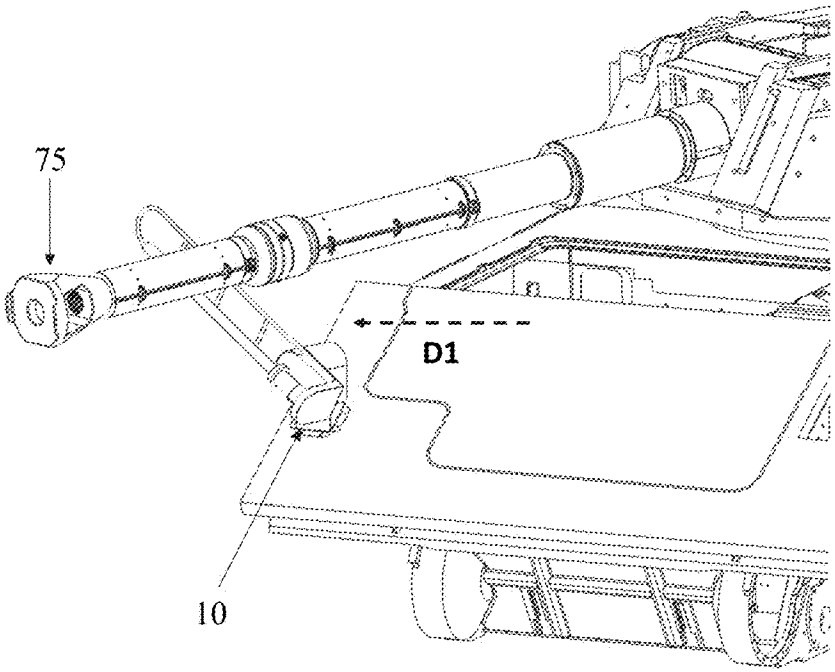
FIGS. 4*a*, 4*b*, 4*c*, 4*d*, 4*e*, and 4*f* show the position of the antenna guard system in relation to a gun barrel moving in a first direction in accordance with an embodiment herein.
Figure 4A:
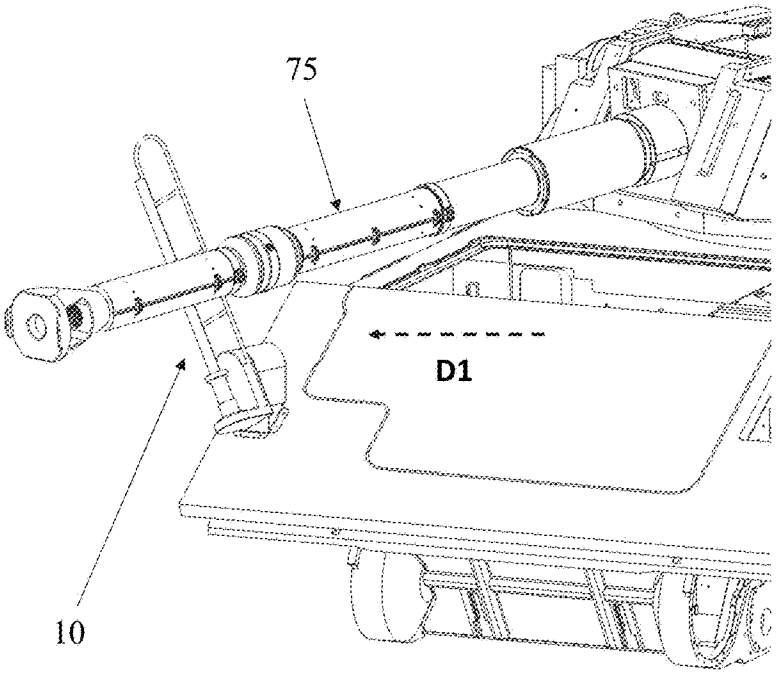
Figure 4D:
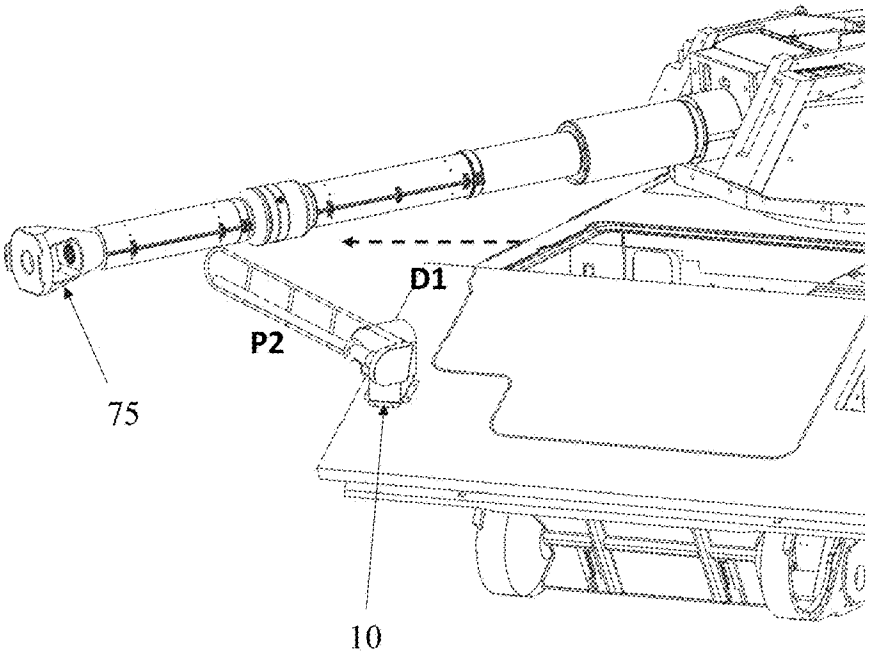
Figure 4C:
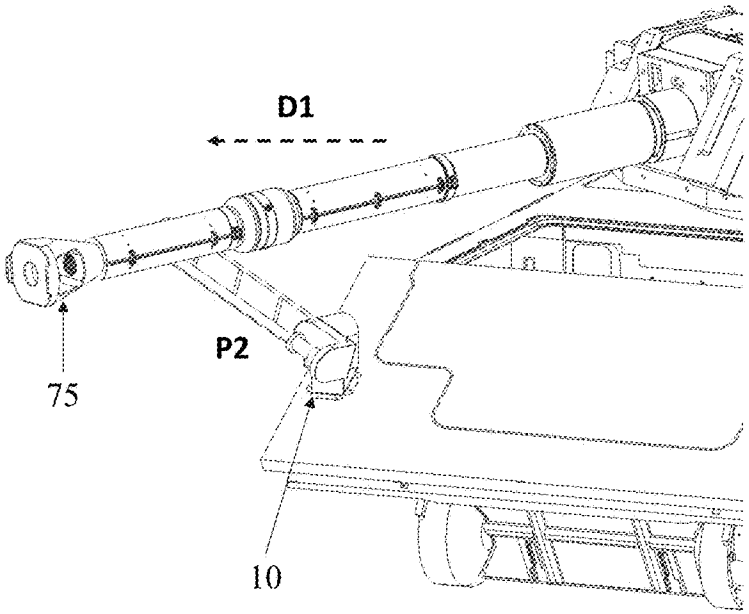
Figure 4F:
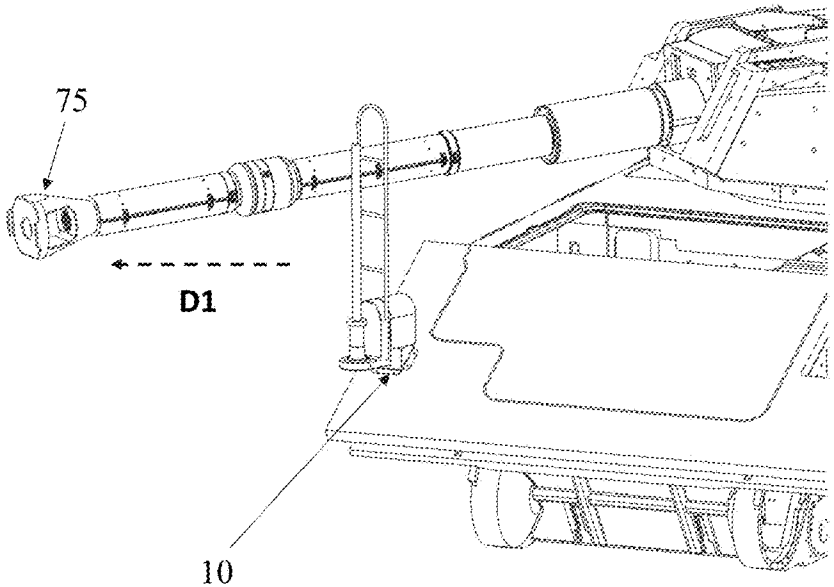
Figure 4E:
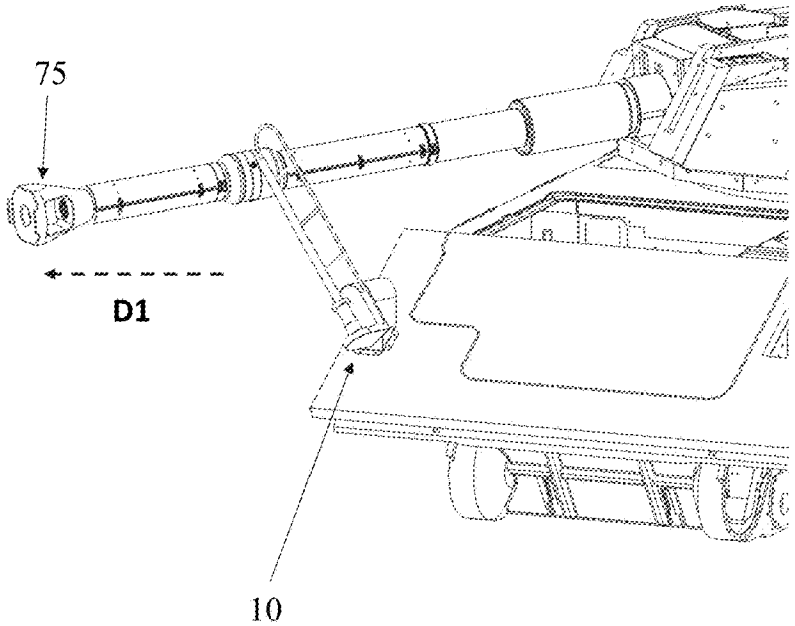
Figure 5B:
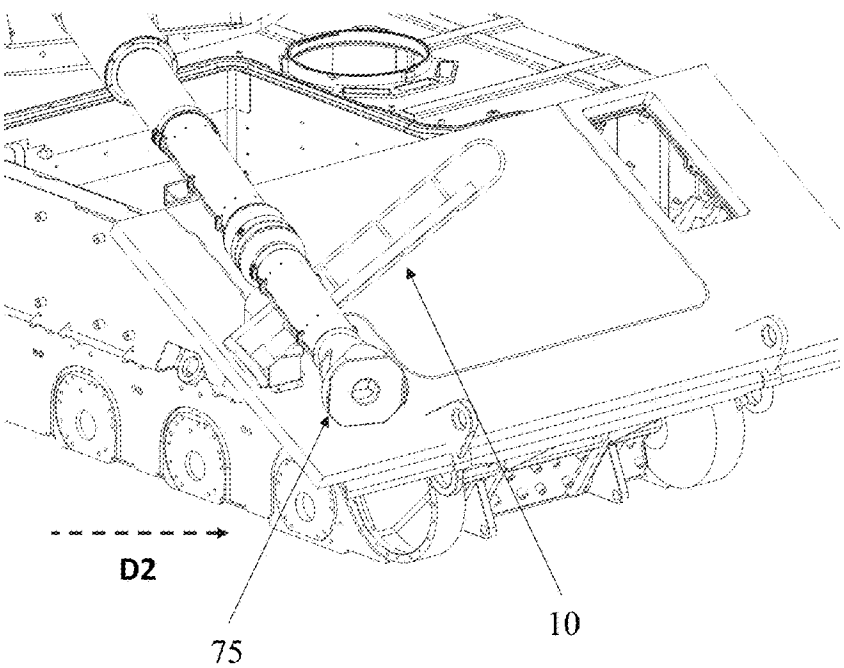
FIGS. 5*a*, 5*b*, 5*c*, 5*d*, 5*e*, 5*f*, 5*g* and 5*h* show the position of the antenna guard system in relation to a gun barrel moving in a second direction in accordance with an embodiment herein.
Figure 5A:
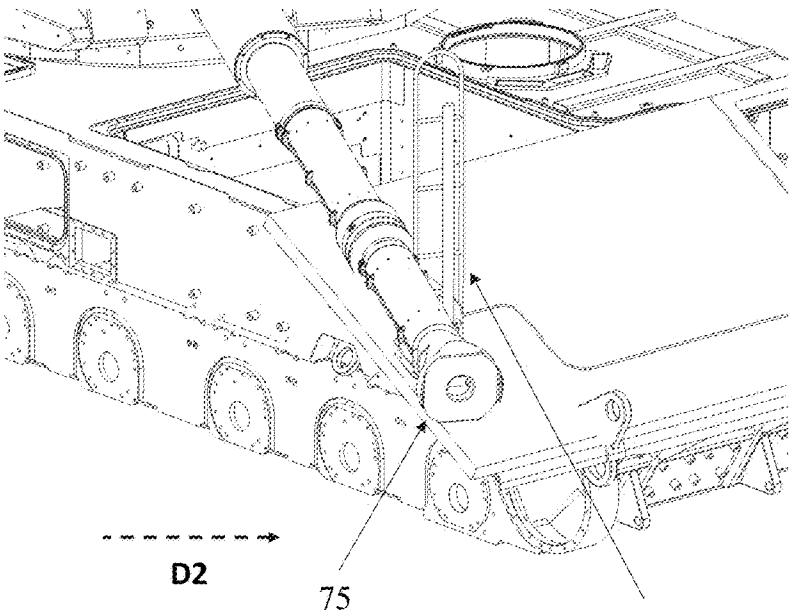
Figure 5D:
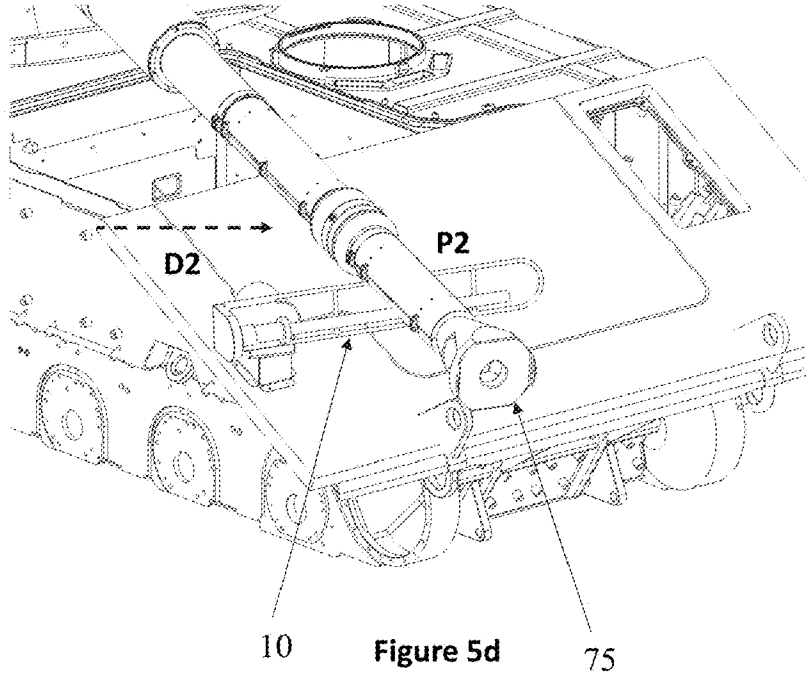
Figure 5C:
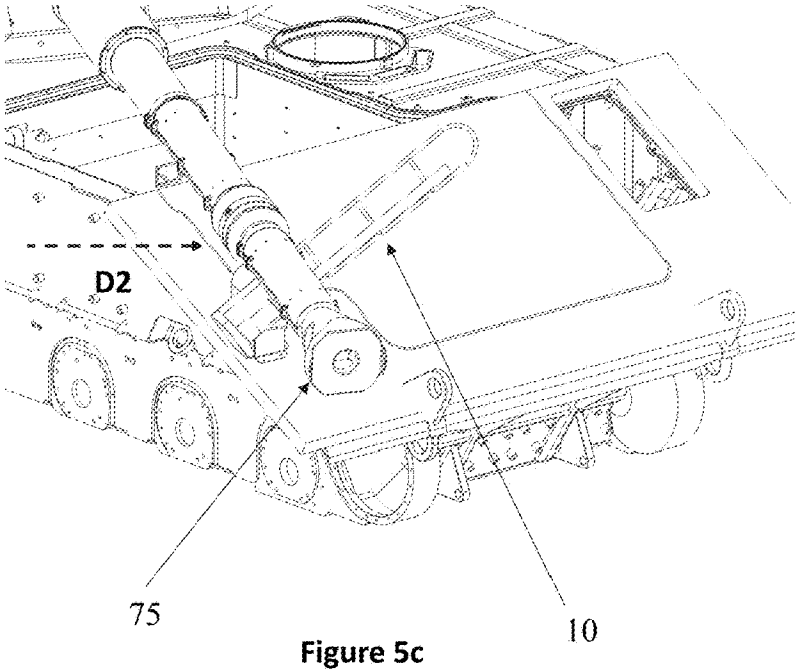
Figure 5E:
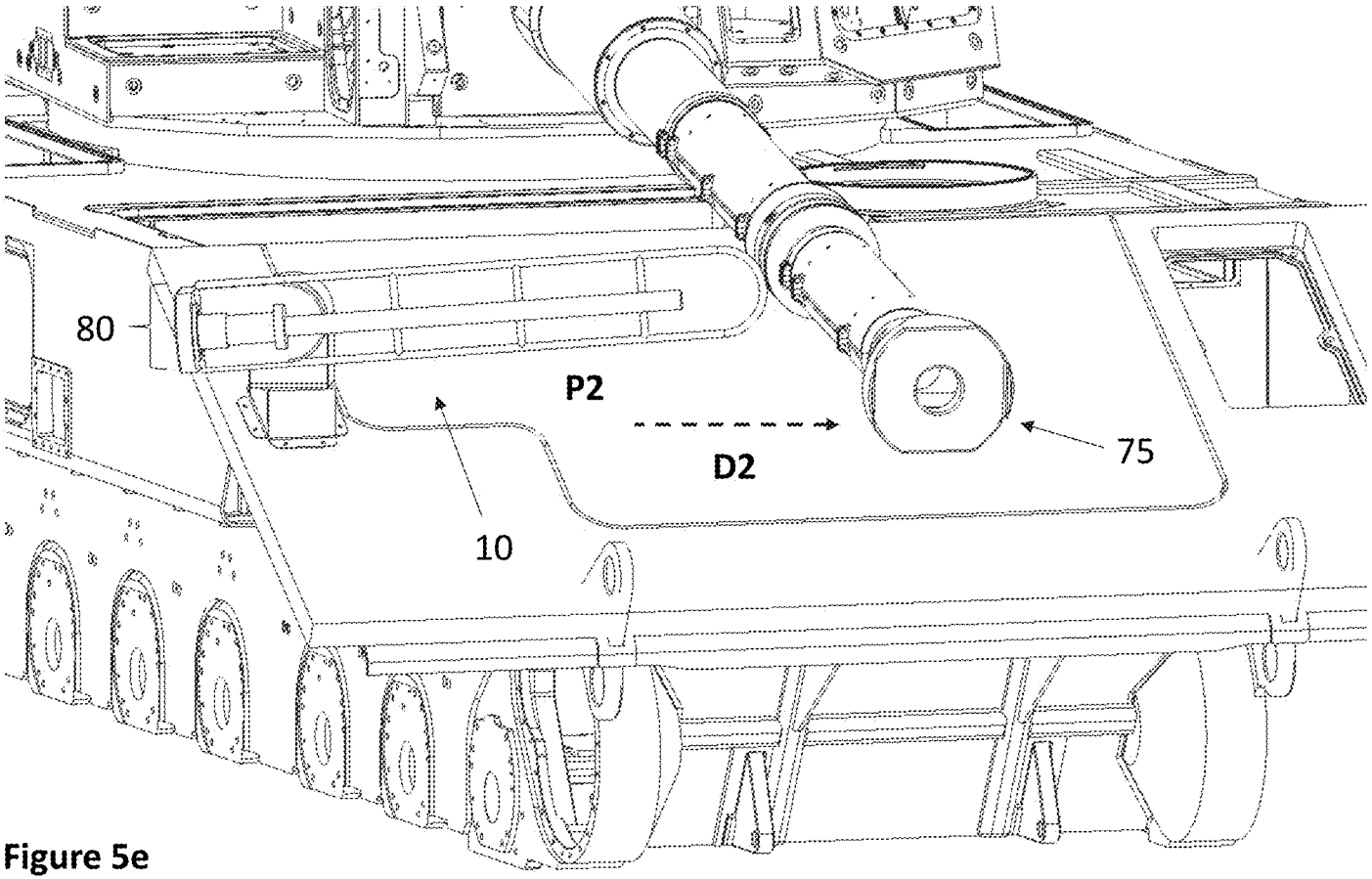
Figure 5F:
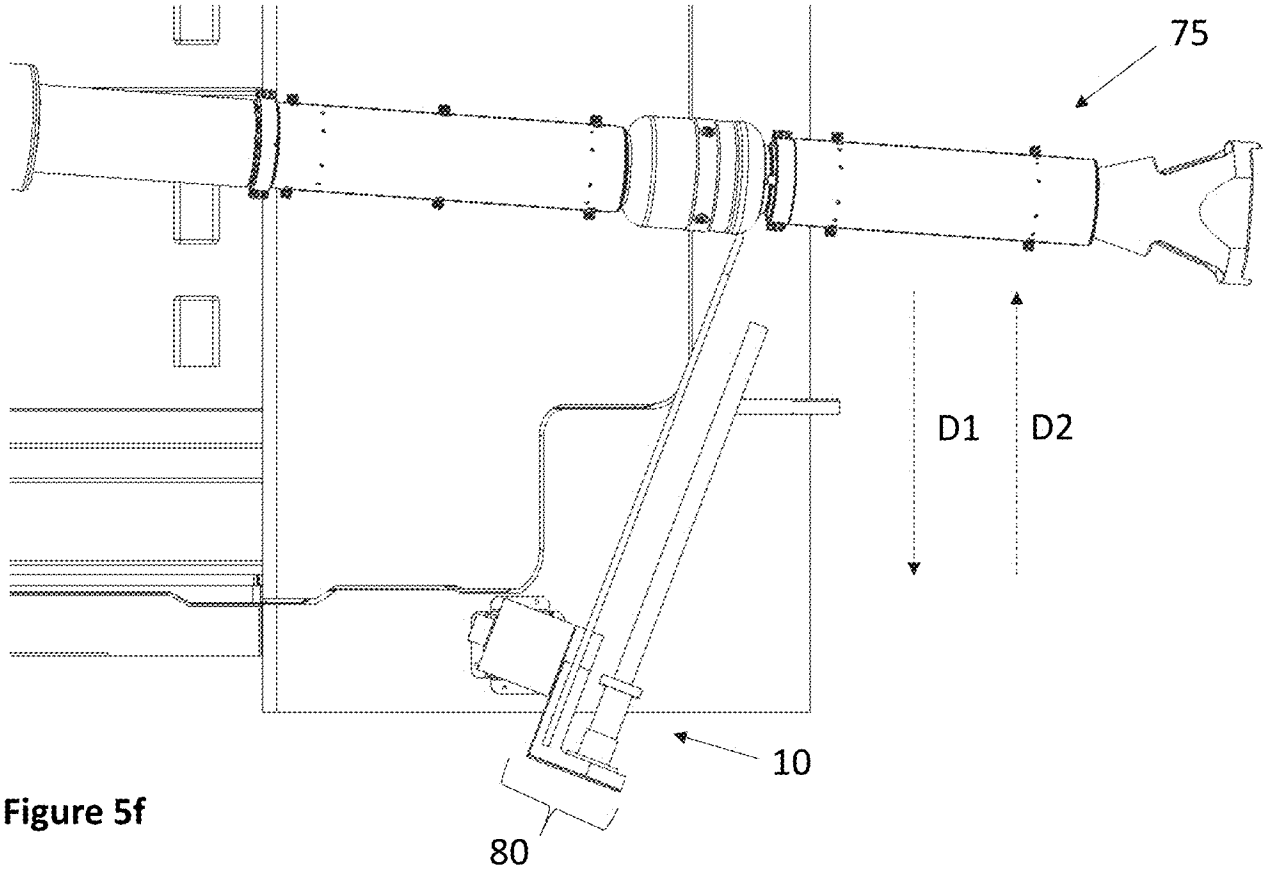
Figure 5H:
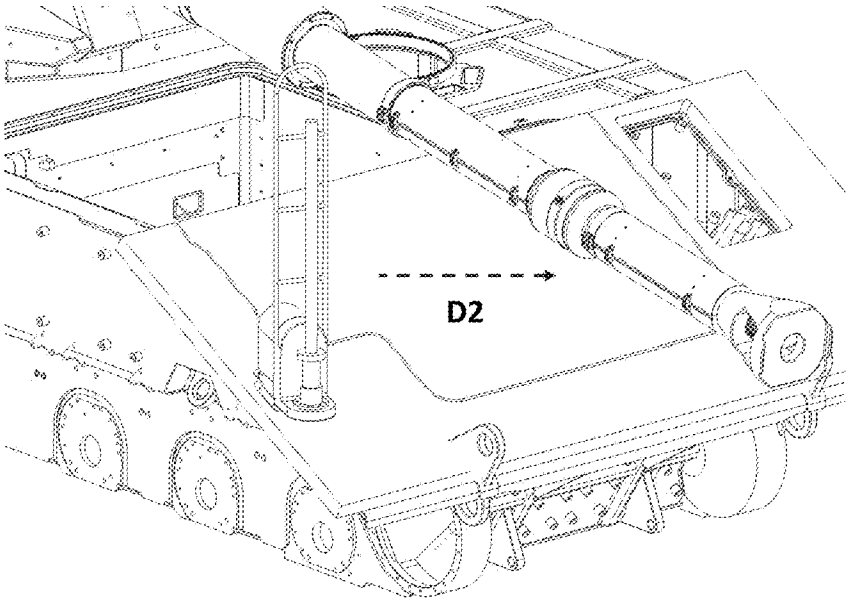
Figure 5G:
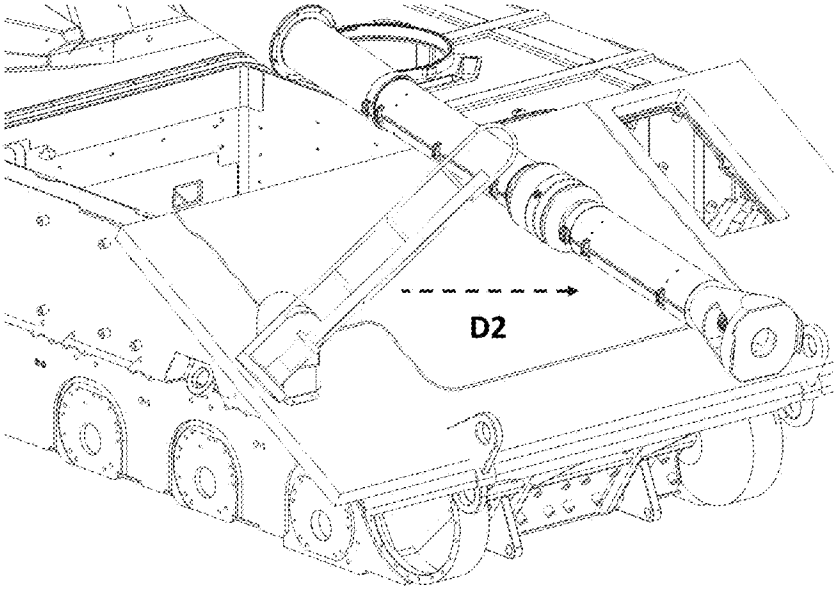

FIGS. 4*d*, 5*e* and 5*f* show the position of the antenna guard system 10 after contact with a gun barrel 75, but just before the antenna guard system 10 has returned to equilibrium and the antenna's start position P1. In FIG. 5*f*, which is a top view of the tank, the gun barrel 75 is moving in the direction (D2) and is just about to clear the antenna guard system 10 which is in end position P2 as shown. As discussed above, in traveling in the direction D2, upon contacting the halo 25 of the antenna guard system 10, the tilt mechanism of the antenna guard system 10 operated to swing a rotating portion 80 of the antenna guard system 10, including the antenna 15 and the halo 25, to the end position P2 from the start position P1, thus allowing the gun barrel 75 to effectively pass over the entire antenna guard system 10.

After the gun barrel 75 clears the halo 25 of the antenna guard system 10, the system automatically returns the rotating portion 80 to the start position P1. In order to facilitate this automatic return, the center-of-gravity for the actual tilting components of the system (e.g., rotating portion 80) may be below the pivot point (e.g., location of turn shaft 35), so that in equilibrium, sub-mount component 20*a*, antenna 15, and halo 25 resume the start position P1. The springs and damper aid in both the initial swing (or rotation) of the sub-mount component 20*a*, antenna 15, and halo 25 to end position P2 and return to equilibrium and start position P1 once the gun barrel has cleared. In addition to aiding with the return to equilibrium after contact with the gun barrel, the spring balance system can be adjusted as would be understood by one skilled in the art to maintain the antenna in its start position, as over time, equilibrium may shift.

In one embodiment, the halo may be formed of welded hollow tubing that is highly polished and coated in solid film lubricant. The material is selected for its durability, but should be of a material that does not interfere with the operation of the antenna. Exemplary materials include carbon fiber or a plastic material like PVC or nylon. One skilled in the art recognizes appropriate materials.

Figure 6:
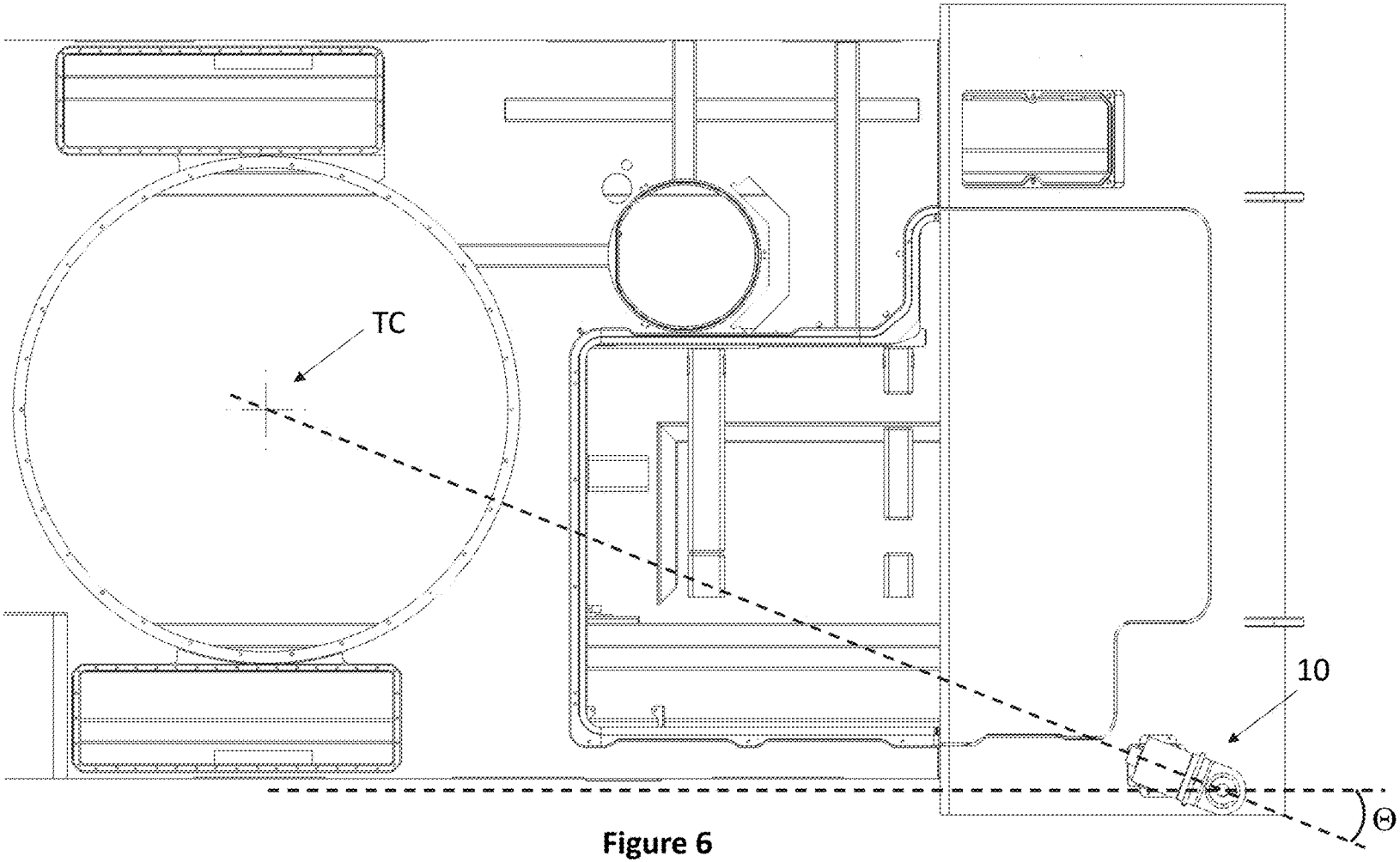
FIG. 6 is a representation showing a preferred angle between an antenna guard system and tank turret in accordance with at least one embodiment described herein.

For the particular embodiment described herein, the antenna guard system 10 may be arranged such that the gun barrel 75 first contacts the halo 25 and not any part of the antenna 15 as it sweeps into the path of the antenna guard system 10. In the non-limiting embodiment illustrated herein, the antenna guard system 10 may be arranged such that it is not completely forward-facing, but instead is facing slightly away from a forwarding facing position of the tank. This arrangement is shown in the top views of FIG. 5*f* and FIG. 6. More particularly, FIG. 6 shows the approximately 21 degree offset (0) of the antenna guard system 10 alignment from the turret center (TC) so that the swing or tilt of the sub-mount component 20*a* including antenna 15 and halo 25 is aligned with the movement of the gun barrel 75. One skilled in the art recognizes that the details regarding this alignment, e.g., angle, will change in accordance with the particular mechanisms in place. The details of FIG. 6 are particular to the tank with moving gun barrel embodiment.

As referenced in the Background, the antenna guard system 10 of one embodiment finds particular use with one or more of the vehicle-mounted antennas that are required as part of Counter-Radio controlled improvised explosive device Electronic Warfare (CREW) developed by SRC, Inc., which is an electronic jammer system designed to prevent the remote detonation of land mines and IEDs One skilled in the art can readily envision the situation wherein a tank is traversing in enemy territory and is in the path of land mines, IEDs or other RF controlled explosive devices. The operators would want the disruptive electronic jammer system to be fully operational and have minimal downtime. At the same time, one can also envision the need for the tank operator to move the turret, and consequently the attached gun barrel, in order to scan the immediate area and/or fire the gun. The antenna guard system 10 described herein minimizes antenna downtime due to gun barrel interference. But the antenna guard system 10 is not limited to use in this particular scenario. One skilled in the art can appreciate that such a system may be used in many other situations wherein vehicle mounted antennas may encounter physical obstacles. The antenna system described herein may be modified for use on a land-based vehicle, a land-based structure, a marine vessel, and an airborne object, including both movable and stationary structures, manned or unmanned.

Figure 7A:
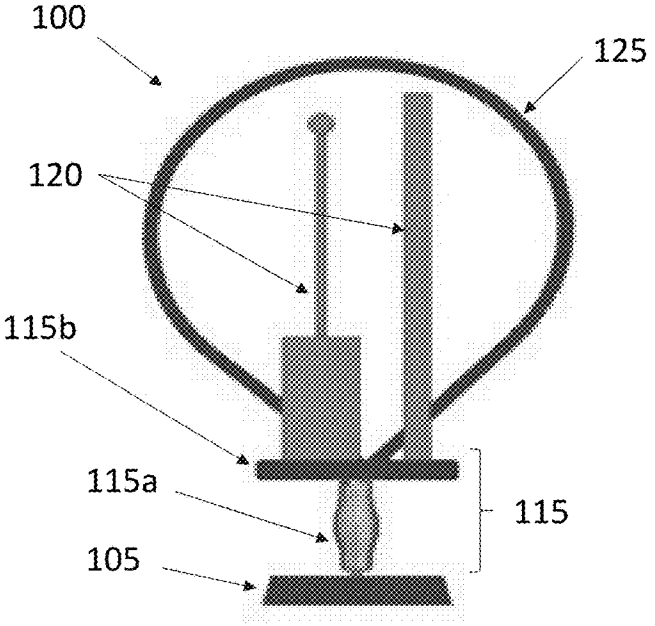
FIGS. 7*a*, 7*b*, and 7*c* are side and alternative top views of an antenna guard system in accordance with at least one embodiment described herein.
Figure 7B:
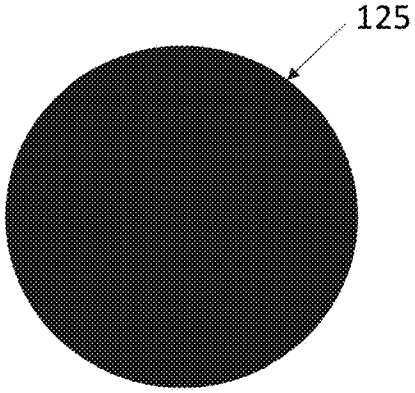
Figure 7C:
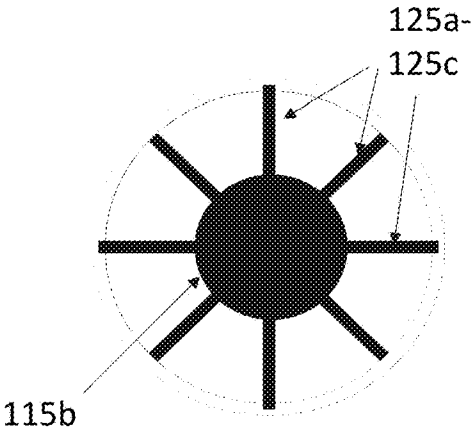

A second embodiment presents antenna guard system 100 as shown in FIGS. 7*a*-7*c*. In the system 100 shown in FIG. 7*a*, a base 105 mounts the system to the body and/or armor of a structure (moving or stationary). A spring mount 115, which includes spring 115*a* and platform 115*b*, is connected to base 105. On top of platform 115*b* one or more antennas 120 are mounted. Also connected to the platform 115*b* is an antenna guard or halo 125. FIGS. 7*b* and 7*c* are different top views of antenna guard system 100 depending on the halo 125 configuration. In FIG. 7*b*, the halo 125 is formed so at to surround the antennas therein, such as in the configuration of a light bulb. The halo material may be carbon fiber or other strong nonmetallic material that will not interfere with the antennas radiation. In FIG. 7*c*, the halo 125 may be formed of strips (125*a*-125*c*) of halo material such that the halo forms more of a cage-like shell around the antennas. It will be appreciated by one skilled in the art that a single halo strip might be sufficient in a scenario, such as the one described above with respect to the first embodiment, wherein a path of an impinging object is known, e.g., a swinging gun barrel. In this particular embodiment, a full coverage halo may not be required.

In either the configuration of FIG. 7*b* or FIG. 7*c*, as objects move into the antenna's space the halo impacts first and allows the platform 115*b* to move with no damage to the antennas. The spring mount 115 provides the flexibility and allows the antenna to move out of the way and then spring back into its operational position.

Figure 8:
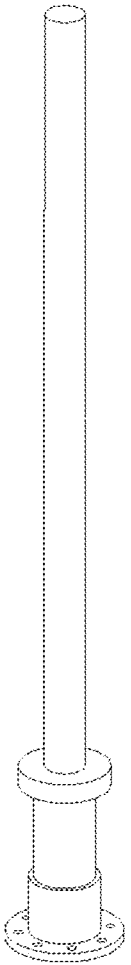
FIG. 8 is an exemplary antenna that may be used in the antenna guard systems described herein.

One skilled in the art recognizes that the size and type of the antenna 15 may vary. Further, more than one antenna may be required on a single vehicle, in which case, each antenna could be implemented with the antenna guard systems described herein. An exemplary antenna is shown in FIG. 8. By way of example only, antennas offered by First RF Corporation and implemented in the CREW Duke counter-IED systems, such as those provided by SRC, Inc., may be used in accordance with the embodiments herein. Referring to the First RF Data Sheet, the physical characteristics vary in accordance with their model number but have a nominal height of 49 inches, weights in the range of 7 to 13 pounds and diameters in a range of 1.4 to 4.5 inches.

The embodiments described herein provide a lower cost, higher reliability solution that does not require additional sensors, actuator motors, cabling, and ballistic holes in the hull. Further, there is no calibration as is required with the current electromechanical solution.

One skilled in the art recognizes the variations to the embodiments and features described herein. By way of example, the type of antenna and the type of underlying vehicle or structure housing the antenna guard system may vary as would be appreciated by those skilled in the art. Such variations are considered to be within the scope of this description.

The invention claimed is:

1. An antenna guard system comprising:

an antenna mounted on a first sub-mount component;

an antenna guard mounted on the first sub-mount component adjacent to the antenna, wherein the antenna guard is wider and higher than the antenna;

a second sub-mount component including a rotatable shaft therethrough, the rotatable shaft connecting the first sub-mount to the second sub-mount for rotating the first sub-mount including the antenna and antenna guard from an operational position in either a first direction or a second, opposite direction and out of a path of a passing object when the antenna guard and not the antenna is contacted by the passing object; and further wherein a balance is movably attached to the rotatable shaft for repositioning the first sub-mount in the operational position once the passing object is no longer contacting the antenna guard.

2. The antenna guard system of claim 1, wherein the balance includes a balance cable, springs and spring anchors.

3. The antenna guard system of claim 1, wherein the rotatable shaft further includes a damper located at an end thereof opposite of the first sub-mount.

4. The antenna guard system of claim 1, further comprising a third sub-mount connected to the second sub-mount, wherein the third sub-mount is securely connected to a structure.

5. The antenna guard system of claim 4, wherein the structure is selected from a group consisting of: a land-based vehicle, a land-based structure, a marine vessel, and an airborne object.

6. The antenna guard system of claim 1, wherein the antenna is a directional antenna.

7. The antenna guard system of claim 1, wherein the antenna guard is formed of hollow tubing.

8. An antenna guard system comprising:

an antenna mounted on a rotatable mount; and an antenna guard mounted on the rotatable mount component adjacent to the antenna, wherein the antenna guard is wider and higher than the antenna;

wherein the antenna guard of the antenna guard system is located in a path of one or more passing objects and further wherein when the antenna guard system is contacted by the one or more passing objects from one of a first or second, opposite direction, the passing object contacts the antenna guard and not the antenna and the rotatable mount rotates to move the antenna guard and the antenna out of the path thereof.

9. The antenna guard system of claim 8, wherein the antenna is a directional antenna.

10. The antenna guard system of claim 8, wherein the antenna guard is formed of hollow tubing.

11. The antenna guard system of claim 8, wherein the rotatable mount includes a weighted spring mechanism for returning the antenna to an operational position once the one or more passing objects clears the antenna guard.

12. The antenna guard system of claim 8, wherein the rotatable mount is rotatable in more than one direction.

13. The antenna guard system of claim 8, wherein the antenna guard system is mounted on a moving structure.

14. The antenna guard system of claim 13, wherein the moving structure is selected from a group consisting of: a land-based vehicle, a marine vessel, and an airborne object.

15. The antenna guard system of claim 8, wherein the one or more passing objects includes a gun barrel.

16. A tank comprising:

a movable turret including a gun barrel; and a directional antenna system located in a path of the gun barrel, the directional antenna system including a rotatable mount having thereon an antenna and an antenna guard, wherein when the gun barrel contacts the antenna guard system from one of a first or second, opposite direction, the gun barrel contacts the antenna guard and not the antenna and the rotatable mount rotates to move the antenna and the antenna guard out of the path of the gun barrel.

17. The tank of claim 16, wherein the antenna guard is formed of hollow tubing.

18. The tank of claim 16, wherein the rotatable mount includes a weighted spring mechanism for returning the antenna to an operational position once the gun barrel clears the antenna guard.

19. The tank of claim 16, wherein the rotatable mount is rotatable in more than one direction.

20. The tank of claim 16, wherein a center line of the directional antenna system is oriented at an angle to a turret center.

21. An antenna guard system comprising:

an antenna mounted on a spring mount; and an antenna guard mounted on the spring mount component adjacent to the antenna, wherein the antenna guard is wider and higher than the antenna;

wherein the antenna guard of the antenna guard system is located in a path of one or more passing objects and further wherein when the antenna guard system is contacted by the one or more passing objects from one of a first or second, opposite direction, the passing object contacts the antenna guard and not the antenna and the spring mount causes the antenna guard and the antenna to move out of the path thereof.

* * * * *